US010908631B2

(12) United States Patent
Ha

(10) Patent No.: US 10,908,631 B2
(45) **Date of Patent: *Feb. 2, 2021**

(54) KNOB ASSEMBLY AND COOKING APPARATUS INCLUDING A KNOB ASSEMBLY

(71) Applicant: LG ELECTRONICS INC., Seoul (KR)

(72) Inventor: Yeonsik Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 249 days.

This patent is subject to a terminal disclaimer.

(21) Appl. No.: 15/899,507

(22) Filed: Feb. 20, 2018

(65) Prior Publication Data

US 2018/0239386 A1 Aug. 23, 2018

(30) Foreign Application Priority Data

Feb. 17, 2017 (KR) ..... 10-2017-0021879

(51) Int. Cl.
*G05G 1/12* (2006.01)
*H01H 19/14* (2006.01)
(Continued)

(52) U.S. Cl.
CPC ..... *G05G 1/12* (2013.01); *F23N 5/203* (2013.01); *F24C 3/126* (2013.01); *H01H 3/20* (2013.01);
(Continued)

(58) Field of Classification Search
CPC . G05G 1/12; F24C 3/126; H01H 3/20; H01H 9/181; H01H 19/025; H01H 3/10;
(Continued)

(56) References Cited

U.S. PATENT DOCUMENTS 98,885 A 1/1870 Roberts
113,455 A 4/1871 Scrannage et al.
(Continued)

FOREIGN PATENT DOCUMENTS

CN 103069227 4/2013
DE 3940378 6/1990
(Continued)

OTHER PUBLICATIONS

Korean Office Action dated Apr. 26, 2020 issued in KR Application No. 10-2018-0152988.
(Continued)

*Primary Examiner* — Lee A Holly
(74) *Attorney, Agent, or Firm* — Ked & Associates LLP

(57) ABSTRACT

A knob assembly and a cooking apparatus including a knob assembly are provided. The knob assembly may reduce defects in assembly and operation of the knob assembly caused by a tolerance of a valve shaft. The knob assembly may include a valve in which a valve shaft may be movable, a knob connected to a knob shaft coupled with the valve shaft, a knob ring that surrounds a periphery of the knob and supports the knob shaft, a support ring coupled with the knob ring, a support frame that supports an outer circumferential surface of the support ring, and a fixing frame coupled with the support frame to prevent the support ring from separating from the support frame.

21 Claims, 9 Drawing Sheets

(51) Int. Cl.

| | |
|---|---|
| ***H01H 19/02*** | (2006.01) |
| ***F24C 3/12*** | (2006.01) |
| ***H01H 3/20*** | (2006.01) |
| ***F23N 5/20*** | (2006.01) |
| *H01H 9/18* | (2006.01) |
| *H01H 3/10* | (2006.01) |
| *H01H 3/02* | (2006.01) |

(52) U.S. Cl.
CPC ..... *H01H 3/0206* (2013.01); *H01H 3/10* (2013.01); *H01H 9/181* (2013.01); *H01H 19/025* (2013.01); *H01H 2003/105* (2013.01); *H01H 2019/143* (2013.01)

(58) Field of Classification Search
CPC ..... H01H 2003/105; H01H 3/0206; H01H 2019/143; H01H 19/14; F23N 5/203; G01D 5/02
See application file for complete search history.

(56) References Cited

U.S. PATENT DOCUMENTS

| | | | |
|---|---|---|---|
| 577,992 | A | 3/1897 | Switzer |
| 636,758 | A | 11/1899 | Casaday |
| 676,118 | A | 6/1901 | Billings |
| 956,912 | A | 5/1910 | Walters |
| 1,358,467 | A | 11/1920 | Robertson |
| 1,491,186 | A | 4/1924 | Bartlett |
| 1,553,312 | A | 9/1925 | Garrecht |
| 1,689,955 | A | 10/1928 | Meacham |
| 1,898,265 | A | 2/1933 | Ragan |
| 1,947,965 | A | 2/1934 | Beggs |
| 1,981,084 | A | 11/1934 | Teller |
| 2,174,342 | A | 9/1939 | Greulich |
| 2,288,425 | A | 6/1942 | Simborg |
| 2,539,840 | A | 1/1951 | Jones |
| 2,626,661 | A | 1/1953 | McDowell |
| 2,631,704 | A | 3/1953 | De Wiess |
| 2,658,979 | A | 11/1953 | Jungholm |
| 2,667,768 | A | 2/1954 | Winkler |
| 2,708,888 | A | 5/1955 | Varney |
| 2,738,758 | A | 3/1956 | Cutler et al. |
| 2,832,409 | A | 4/1958 | Lee et al. |
| 2,837,154 | A | 6/1958 | Harper et al. |
| 2,865,594 | A | 12/1958 | Winfree |
| 2,895,314 | A | 7/1959 | Helm |
| 2,945,364 | A | 7/1960 | Marquis |
| 2,983,119 | A | 5/1961 | Glover |
| 3,212,290 | A | 10/1965 | Walden |
| 3,304,001 | A | 2/1967 | Forte |
| 3,528,263 | A | 9/1970 | Stern |
| 3,572,055 | A | 3/1971 | Billey |
| 3,595,273 | A | 7/1971 | Kolodziej |
| 3,609,994 | A | 10/1971 | Colletti et al. |
| 3,844,137 | A | 10/1974 | Zugel |
| 3,858,129 | A | 12/1974 | Ashida et al. |
| 4,065,941 | A | 1/1978 | Aoki |
| 4,092,871 | A | 6/1978 | Cunningham |
| 4,540,383 | A | 9/1985 | Taig |
| 4,692,127 | A | 9/1987 | Wagner |
| 4,868,530 | A | 9/1989 | Ahs |
| 4,964,840 | A | 10/1990 | Kapaan |
| 5,284,455 | A | 2/1994 | Kuribayashi |
| 5,436,413 | A | 7/1995 | Katakami |
| 5,458,028 | A | 10/1995 | Cleveland, III |
| 5,665,946 | A | 9/1997 | Nishijima et al. |
| 5,693,245 | A | 12/1997 | Clizbe |
| 6,031,439 | A | 2/2000 | Adams et al. |
| 6,325,724 | B1 | 12/2001 | Sato |
| 6,621,016 | B2 | 9/2003 | Ohba et al. |
| 6,627,828 | B1 | 9/2003 | McCartney |
| 7,171,727 | B2 | 2/2007 | Wylie et al. |
| 7,479,607 | B2 | 1/2009 | Sack et al. |
| 8,079,287 | B2 | 12/2011 | Castillo |
| 8,783,646 | B2 | 7/2014 | Wasser |
| 8,997,591 | B1 | 4/2015 | Vircks |
| 9,593,855 | B2 | 3/2017 | Moro et al. |
| 9,646,783 | B1 | 5/2017 | Stoufer et al. |
| 10,248,153 | B2 | 4/2019 | Stoufer et al. |
| 10,288,065 | B1 | 5/2019 | Smid |
| 10,466,736 | B2 | 11/2019 | Stoufer |
| 10,746,409 | B2 | 8/2020 | Ha |
| 2004/0070574 | A1 | 4/2004 | Wylie et al. |
| 2007/0181410 | A1 | 8/2007 | Baier |
| 2008/0053806 | A1 | 3/2008 | Stoffers et al. |
| 2008/0121067 | A1 | 5/2008 | Uhlin |
| 2009/0263186 | A1 | 10/2009 | Hofmann |
| 2009/0293654 | A1 | 12/2009 | Pintauro |
| 2010/0043499 | A1 | 2/2010 | Choi et al. |
| 2010/0265176 | A1 | 10/2010 | Olsson et al. |
| 2011/0005508 | A1* | 1/2011 | Albizuri ..... F23D 17/002 126/39 E |
| 2012/0115096 | A1 | 5/2012 | Gadini et al. |
| 2012/0204854 | A1 | 8/2012 | Dondurur et al. |
| 2012/0215475 | A1 | 8/2012 | Rutledge et al. |
| 2014/0260775 | A1 | 9/2014 | Freeman et al. |
| 2015/0005081 | A1 | 1/2015 | Harnetiaux |
| 2015/0122134 | A1 | 5/2015 | Moro et al. |
| 2015/0153047 | A1 | 6/2015 | Moro et al. |
| 2015/0153048 | A1 | 6/2015 | Moro et al. |
| 2016/0053803 | A1 | 2/2016 | Yu |
| 2016/0097541 | A1 | 4/2016 | Choi |
| 2016/0170436 | A1 | 6/2016 | Farrar et al. |
| 2017/0083039 | A1 | 3/2017 | Wuisan et al. |
| 2017/0235326 | A1 | 8/2017 | Koschinat |
| 2017/0351292 | A1 | 12/2017 | Stoufer et al. |
| 2018/0210484 | A1 | 7/2018 | Stoufer |
| 2018/0239386 | A1 | 8/2018 | Ha |
| 2018/0259996 | A1 | 9/2018 | Stoufer et al. |
| 2019/0024903 | A1 | 1/2019 | Ha |
| 2019/0101949 | A1 | 4/2019 | Takizawa et al. |

FOREIGN PATENT DOCUMENTS

| | | |
|---|---|---|
| DE | 102 55 676 | 6/2004 |
| DE | 10-2005-045300 | 9/2006 |
| DE | 10-2007-035564 | 1/2009 |
| EP | 0 412 041 | 2/1991 |
| EP | 0 584 400 | 3/1994 |
| EP | 1 962 167 | 8/2008 |
| EP | 2 088 357 | 8/2009 |
| EP | 2 587 161 | 5/2013 |
| EP | 2 703 671 | 3/2014 |
| GB | 322884 | 12/1929 |
| GB | 2 081 874 | 2/1982 |
| GB | 2 178 134 | 2/1987 |
| JP | S 5660922 | 5/1981 |
| JP | S56-77793 | 6/1981 |
| JP | S 5761860 | 4/1982 |
| JP | 60065909 | 4/1985 |
| JP | 60249729 | 12/1985 |
| JP | H 01-136723 | 9/1989 |
| JP | 2716246 | 2/1998 |
| JP | H 11-000140 | 11/1999 |
| JP | 2006-118539 | 5/2006 |
| JP | 2012-003588 | 1/2012 |
| JP | 2015-190560 | 11/2015 |
| JP | 2016-217593 | 12/2016 |
| JP | 2017-157397 | 9/2017 |
| KR | 20-1989-0013720 | 8/1989 |
| KR | 10-1994-0026468 | 12/1994 |
| KR | 10-1998-0021844 | 6/1998 |
| KR | 20-1998-0020482 | 7/1998 |
| KR | 1998-0020482 | 7/1998 |
| KR | 1998-0052401 | 10/1998 |
| KR | 10-0175848 | 3/1999 |
| KR | 10-1999-0031371 | 5/1999 |
| KR | 10-2000-0008085 | 2/2000 |
| KR | 20-2000-0006636 | 4/2000 |
| KR | 20-0193805 | 8/2000 |
| KR | 10-2007-0064981 | 6/2007 |
| KR | 10-0941463 | 2/2010 |
| KR | 10-2012-0140490 | 12/2012 |

(56) References Cited

FOREIGN PATENT DOCUMENTS

| | | |
|---|---|---|
| KR | 10-2015-0128172 | 11/2015 |
| WO | WO 2013/175438 | 11/2013 |
| WO | WO 2013/175441 | 11/2013 |
| WO | WO 2015/008092 | 1/2015 |

OTHER PUBLICATIONS

Korean Office Action dated Aug. 20, 2019.
U.S. Office Action dated Dec. 11, 2019 issued in U.S. Appl. No. 15/899,637.
European Office Action dated Aug. 5, 2019.
United States Office Action dated Jan. 24, 2020 issued in co-pending related U.S. Appl. No. 15/899,730.
U.S. Office Action dated Aug. 21, 2019 issued in co-pending U.S. Appl. No. 15/899,797.
European Search Report dated Oct. 10, 2018 issued in Application No. 18157383.3.
European Search Report dated Jul. 18, 2018 issued in Application No. 18157319.7.
European Search Report dated Jul. 18, 2018 issued in Application No. 18157431.0.
European Search Report dated Jul. 19, 2018 issued in Application No. 18157306.4.
European Search Report dated Jul. 19, 2018 issued in Application No. 18157312.2.
Korean Notice of Allowance dated Jul. 20, 2018 issued in Application No. 10-2017-0023774.
Korean Office Action dated Jan. 21, 2020 issued in Application No. 10-2017-0094806.
Korean Office Action dated Apr. 9, 2020 issued in Application No. 10-2018-0136829.
European Search Report dated Feb. 24, 2020 issued in Application No. 19209191.6.
European Search Report dated Nov. 27, 2018 issued in Application No. 18157306.4.
Korean Notice of Allowance dated Jan. 13, 2020 issued in Application No. 10-2017-0093734.
Korean Notice of Allowance dated Jan. 13, 2020 issued in Application No. 10-2017-0167073.
Chinese Office Action dated Mar. 4, 2020 issued in Application No. 201811486621.X.
U.S. Notice of Allowance dated Sep. 9, 2020 issued in U.S. Appl. No. 15/899,583.
U.S. Appl. No. 15/899,637, filed Feb. 20, 2018.
U.S. Appl. No. 15/899,730, filed Feb. 20, 2018.
U.S. Appl. No. 15/899,797, filed Feb. 20, 2018.
U.S. Appl. No. 15/899,507, filed Feb. 20, 2018.
U.S. Appl. No. 15/899,583, filed Feb. 20, 2018.
U.S. Appl. No. 16/911,896, filed Jun. 25, 2020.
U.S. Appl. No. 16/986,942, filed Aug. 6, 2020.
U.S. Appl. No. 16/923,566, filed Jul. 8, 2020.
Korean Office Action dated Jul. 29, 2020 issued in KR Application No. 10-2017-0094806.
Korean Office Action dated Oct. 17, 2020 issued in KR Application No. 10-2018-0136829.
Korean Office Action dated Oct. 17, 2020 issued in KR Application No. 10-2018-0152988.

* cited by examiner

KNOB ASSEMBLY AND COOKING APPARATUS INCLUDING A KNOB ASSEMBLY

CROSS-REFERENCE TO RELATED APPLICATION

This application claims priority under 35 U.S.C. § 119 to Korean Application No. 10-2017-0021879 filed on Feb. 17, 2017, whose entire disclosure is incorporated herein by reference.

BACKGROUND

1. Field

A knob assembly and a cooking apparatus including a knob assembly are disclosed herein.

2. Background

A cooking apparatus is a home appliance that cooks food or other items (hereinafter "food") and may be provided or installed in a kitchen. Such cooking apparatuses may be classified by heating source, shape, and/or type of fuel used. Cooking apparatuses may also be classified according to a form of cooking food, for example, there may be open-type and closed-type cooking apparatuses according to how food is loaded or cooked into or on the cooking apparatus. Closed-type cooking apparatuses may include an oven, or a microwave oven, for example. Open-type cooking apparatuses may include a cooktop, or a hob, for example.

Closed-type cooking apparatuses may be cooking apparatuses that shield a space in which food is positioned and heat the space to cook the food. Open-type cooking apparatuses may be cooking apparatuses in which food or a container in which food is contained is positioned in or provided on an open space, and the food or the container for food is heated to cook the food.

In the closed-type cooking apparatus, a cooking compartment may be provided which may be a space in which food may be loaded and which may be shielded to cook the food. The cooking compartment may be a space in which food is cooked. A heating source may be provided in the cooking compartment or in an external space thereof to heat the cooking compartment.

A combined cooking apparatus may be provided in which a closed-type cooking apparatus and an open-type cooking apparatus are both provided or installed, and a plurality of heating sources may be used to cook various foods at the same time. In the combined cooking apparatus, the open-type cooking apparatus may be positioned above the closed-type cooking apparatus. A plurality of heaters or burners may be installed on the open type cooking apparatus to cook a plurality of food at the same time. For example, if a user barbecues meat or fish or makes bread, the closed-type cooking apparatus may be used to cook such food. If a user cooks food in a container, the open-type cooking apparatus with an exposed top may be used to cook the food.

The open-type cooking apparatus may include a gas range, which may cook food using flames generated when gases are burnt. There are several methods of adjusting a flame strength of a cooking apparatus. A method of adjusting heating power may include adjusting a rotational amount of a knob that rotates around a predetermined rotational shaft. The knob may be connected to a valve that controls a flow rate of gases to mechanically control an opening degree of the valve. Such methods may also include electronically measuring a rotational amount of a knob and electronically controlling an opening degree of a valve based on a measured result.

The knob may be rotatably installed on a rotational shaft. As the knob may not be externally aligned due to a size error in a manufacturing process or an assembly deviation in an assembling process, an external shape of the knob may be spoiled and a malfunction of the knob may occur.

BRIEF DESCRIPTION OF THE DRAWINGS

Embodiments will be described in detail with reference to the following drawings in which like reference numerals refer to like elements, and wherein.

DETAILED DESCRIPTION

Figure 1:
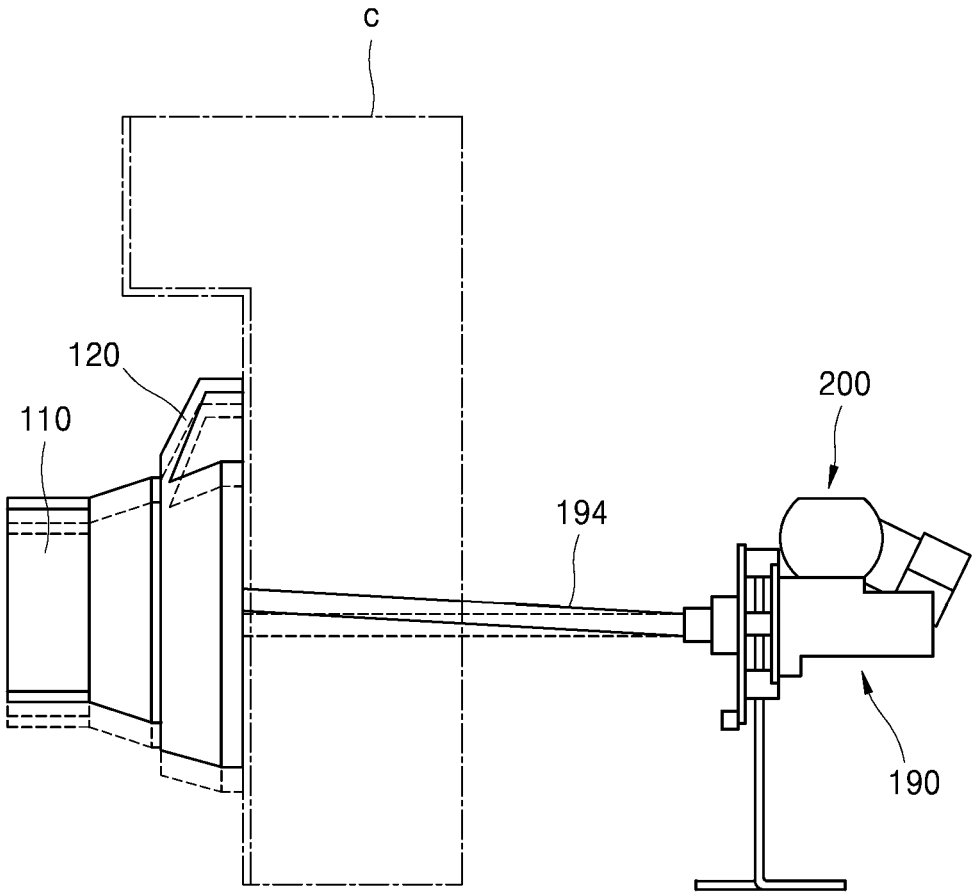
FIG. 1 is a view of a knob assembly of a cooking apparatus according to an embodiment.
Figure 2:
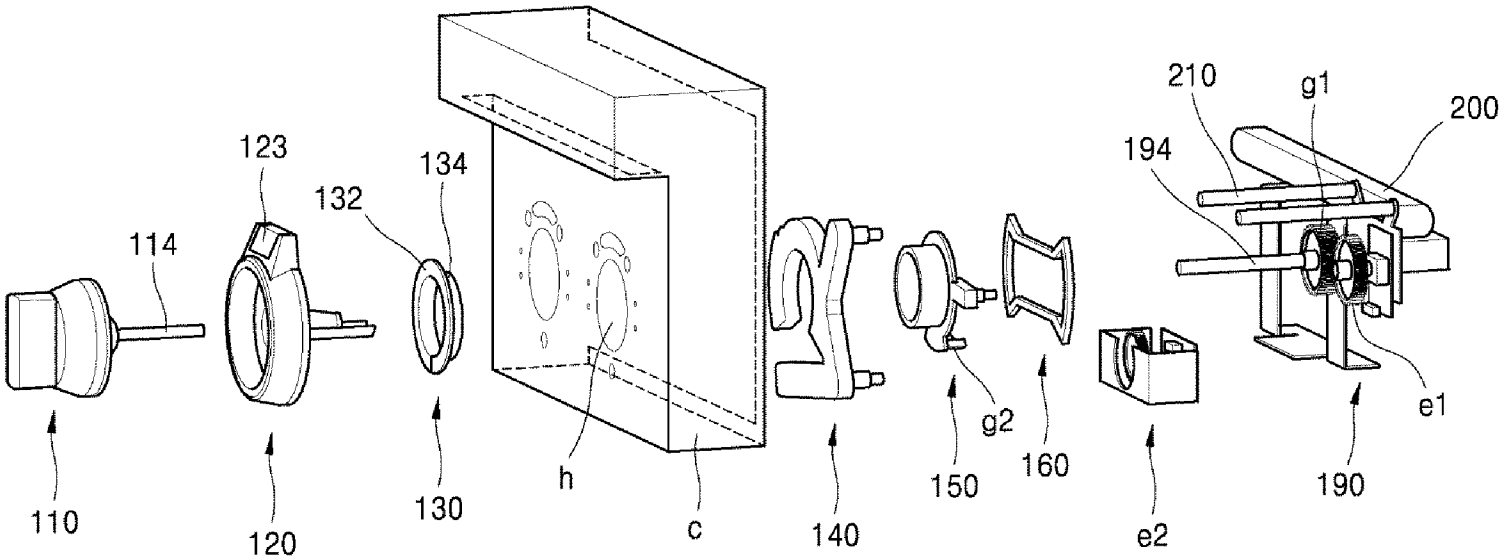
FIG. 2 is an exploded view of the knob of FIG. 1.
Figure 3:
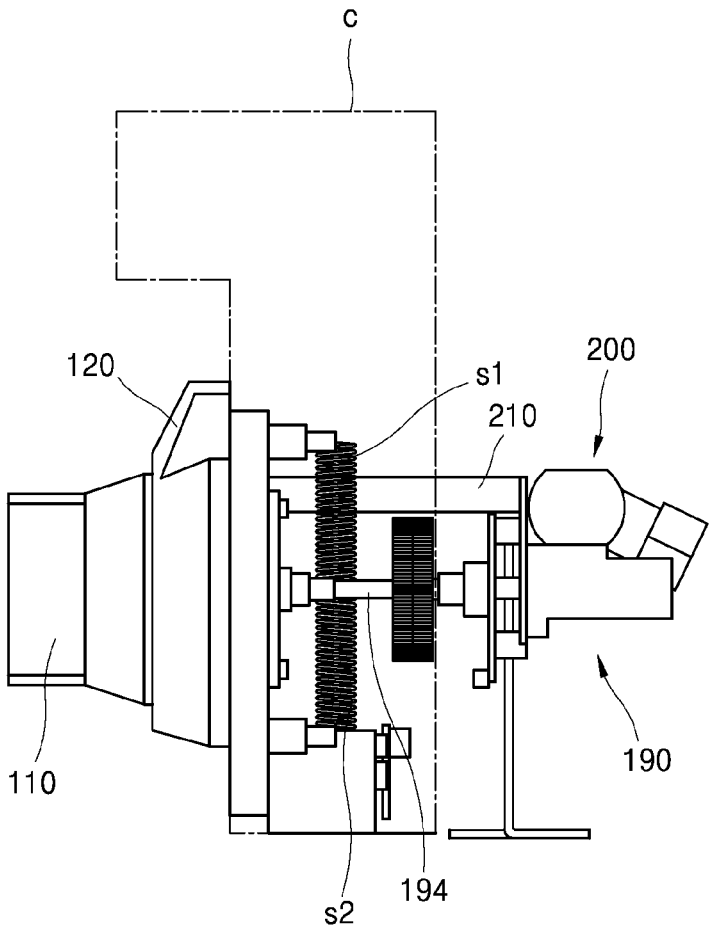
FIG. 3 is an assembled view of the knob assembly of FIG. 1.

Referring to FIG. 1, a knob assembly for a cooking apparatus may include a valve 190 that adjusts a gas supply amount to a burner of the cooking apparatus. The valve 190 may be adjusted by a knob handle or knob 110 exposed in front of a front panel c. The valve 190 and the knob handle 110 may be connected by a valve shaft 194 connected to the valve 190. The knob handle 110 may be coupled with the valve shaft 194 in such a way that the knob handle 110 is turned and to operate the valve 190. The valve 190 may include the valve shaft 194. An opening degree of the valve 190 may be adjusted by rotation of the valve shaft 194. Changing the opening degree of the valve 190 may adjust heating power of the burner.

The knob handle 110 and a knob ring 120 that annularly surrounds the knob handle 110 may be provided on or at an exterior of the front panel c. The knob handle 110 may be coupled with the valve shaft 194 so that the valve 190 may be adjusted by the knob handle 110. As the valve 190 may be manufactured, for example, using a method of welding a cast, there may be a position tolerance of the valve shaft 194 during manufacturing. Such tolerance of the valve shaft 194 may cause a deviation or change in position of the knob handle 110 when it is assembled with the valve shaft 194. The deviation in position of the knob handle 110 may increase when a length of the valve shaft 194 is increased. The tolerance of the valve shaft 194 may be directly related to assembly tolerance between the knob handle 110 and the knob ring 120 assembled with the valve shaft 194.

Referring to FIG. 1, an original assembling position of the knob handle 110 and the knob ring 120 is represented by a dotted line. When the tolerance of the valve shaft 194 occurs, the assembling position of the knob handle 110 and the knob ring 120 may be changed, as represented by a solid line.

A plurality of burners may be provided in or on a cooking apparatus. In such a cooking apparatus with a plurality of burners, a plurality of knob handles 110 and knob rings 120 may be connected to a plurality of valves 190 thereof. When a tolerance occurs in respective valve shafts 190, alignment between the knob handles 110 and the knob rings 120 may be off and may deteriorate an external appearance of the cooking apparatus.

The tolerance of the valve shaft 194 may cause not only a simple external defect but may also cause a malfunction. This is because rotation of the knob handle 110 may not be smooth during operation due to the twisted valve shaft 194 and a defect when the knob handle 110 is inserted and does not return may occur. To solve the above-described problems, embodiments disclosed herein may improve external quality or appearance and may reduce malfunctions by assembling the knob handle 110 and the knob ring 120 at a precise position.

A knob handle may be connected to a valve shaft of a valve. The valve shaft may have a structure which may be rotatable only at a fixed position with respect to the valve. Accordingly, there may be a problem in which twisting of the valve shaft 194 may be directly transferred to the knob handle.

According to embodiments disclosed herein, a position of the knob handle 110 may not be changed or rotated by the valve shaft 194, rather, the valve shaft 194 may be moved corresponding to a position of the knob handle 110 by applying a valve 190 that allows the valve shaft 194 to be moved upward, downward, and laterally with respect to the valve 190.

In a related art cooking apparatus, a position of a knob handle may be determined only by a valve shaft. However, even though the knob handle 110 according to embodiments may be fixed at a position aligned based on the front panel c, the valve shaft 194 of the valve 190 may be moved by the valve 190 with the valve shaft 194.

The knob handle 110 may have a circular shape including a handle portion that protrudes. The handle portion may have a protruding bar shape but may also be in various shapes and embodiments are not limited thereto. The knob handle 110 may be manufactured, for example, using a synthetic resin injection material but may also be manufactured by processing a metal material. A material and shape of the knob handle 110 may be varied.

A knob ring 120 may be provided on an outer circumferential surface of the knob handle 110 to improve an external shape of the knob handle 110. The knob ring 120 may support the knob handle 110 and finish the external shape around the knob handle 110 to improve quality and appearance.

The knob ring 120 may restrict a position of the knob handle 110. As the knob handle 110 moves upward, downward, and laterally, the knob handle 110 coupled only with the valve shaft 194 may also move accordingly. The knob ring 120 may restrict a position of the knob handle 110 to allow the knob handle 110 to remain at a predetermined position.

The knob ring 120 may be configured to perform as or may include a timer-operating switch and a display 123 that displays time and a level of heating power. The knob ring 120 may be configured to be independently rotatable from the knob handle 110 so that the time may be set by operating the knob ring 120. The knob ring 120 may include the display 123 to display the time and the level of heating power through the display 123.

A knob encoder e1 that senses a rotational amount of the knob handle 110 and a knob ring encoder e2 that senses a rotational amount of the knob ring 120 may be included. The knob encoder e1 may sense a rotational amount of a gear g1 coupled with the valve shaft 194, and the knob ring encoder e2 may sense rotation of a gear g2 included in a support ring 150.

The knob handle 110 and the knob ring 120 may be exposed outward from the front panel c of the cooking apparatus. The heating power and the time of the timer may be displayed on the display 123. The heating power displayed on the display 123 may be sensed from the rotation amount of the knob handle 110. The time of the timer displayed on the display 123 may be sensed by operation of the knob ring 120.

The display 123 may include a part or area that displays the heating power and a part or area that displays the time of the timer or may be configured to selectively display the heating power and the time of the timer through one display 123 as shown in the drawing. However, embodiments are not limited thereto. For example, when the timer is not set, only heating power may be displayed. When the timer is set, heating power may be displayed for a set or predetermined time and then a time of the timer may be displayed for a set or predetermined time.

A color of a lighting device when the heating power is displayed may be different from a color of a lighting device when the time of the timer is displayed so that a user may easily check or determine whether a displayed number indicates the heating power or the time of the timer. For example, the heating power may be displayed in a red color and the time of the timer may be displayed in a white or blue color. When both the heating power and the time of the timer are displayed, the heating power may be displayed for two seconds and then the time of the timer may be displayed for two seconds.

The heating power and the time of the timer may be adjusted through the knob assembly. When both the heating power and the time of the timer are displayed through the knob assembly, an additional display portion or display on the front panel c may be unnecessary. The above-described knob assembly may be applied to all oven ranges including ovens and cook tops having only burners and may have an advantage of being used as a common component among them.

A support ring 150 may be coupled with a rear surface of the knob ring 120 and may rotate while being integrated with the knob ring 120. A rotational amount of the support ring 150 and a rotational amount of the knob ring 120 may be identical. Accordingly, operation of the knob ring 120 may be sensed by sensing the rotational amount of the support ring 150. For this, the support ring 150 may include the gear g2.

A support frame 140 may be coupled with the front panel c and may support the knob ring 120. The knob handle 110 and the knob ring 120 may be coupled at a predetermined position on the front panel c, and the front panel c may be formed of a thin metal film material, for example. When a hole h is formed at the front panel c and the knob ring 120 rotates while in contact with the hole h, a problem in which the knob ring 120 may be cut or ground off may occur. Accordingly, the support frame 140 may be coupled with the hole h formed at the front panel c.

The support frame 140 may include a guide groove corresponding to an outer diameter of the support ring 150 coupled with the knob ring 120. The support ring 150 may be supported by the support frame 140 at an outer circumferential surface thereof and may be rotated at a predetermined or predetermined position.

As a position of the knob ring 120 may be determined by the support frame 140 and the support frame 140 may be fastened to the front panel c, the position of the knob ring 120 may be fixed based on the front panel c. The support frame 140 may surround the outer circumferential surface of the support ring 150 and may support the support ring 150 to rotate around a fixed axis.

The support frame 140 may be fastened to a frame 200, such as a burner frame, to which the valve 190 may be fixed, through a guide bar 210. The guide bar 210 may fix the frame 200 and the support frame 140 so that the support frame 140 may be fixed with respect to the frame 200.

A fixing frame 160 may be fastened and fixed to the support frame 140 by a fastening means, such as, for example, a screw, and may prevent the support ring 150 from deviating or moving backward from the fixing frame 160 toward an inside of the cooking apparatus or separating from the support frame 140. The fixing frame 160 may restrict a rotational range of the support ring 150 so that the support ring 150 and the knob ring 120 may only rotate laterally within a predetermined angle range.

The fixing frame 160 may be formed in a bow-tie shape in which an angle of incidence of a part or portion corresponding to a wing thereof may limit or restrict the support ring 150 to rotate within the angle range, and a part or portion that connects both wings may prevent the support ring 150 from deviating backward.

A bearing shell 130 may allow the knob ring 120 to be smoothly operated. The bearing shell 130 may include a cylinder portion 134 having a cylindrical shape and a disc portion 132 which may be bent from the cylinder portion 134 and protrude in a radial direction.

The cylinder portion 134 may be inserted between the outer circumferential surface of the support ring 150 coupled with the knob ring 120 and an inner circumferential surface of the fixing frame 160 and may reduce friction between the support ring 150 and the fixing frame 160. The disc portion 132 may be inserted between the front panel c and the knob ring 120 at the hole h in the front panel c and may reduce friction between the knob ring 120 and the front panel c. The disc portion 132 may allow the knob ring 120 to be spaced apart at a predetermined interval from the front panel c to reduce scratches at the front panel c caused by operation of the knob ring 120.

The knob ring 120 may have a return type or restoring operation structure. The knob ring 120 may be rotated clockwise or counterclockwise due to an external force within a predetermined angle range but may return to an original position when the external force is released. Restoring springs s1 and s2 may provide restoration forces that return the knob ring 120 to the original position. The restoring springs s1 and s2 may include a first restoring spring s1 that provides a clockwise restoration force and a second restoring spring s2 that provides a counterclockwise restoration force. When an external force is not applied, elastic forces of the first restoring spring s1 and the second restoring spring s2 balance in such a way that the knob ring 120 may be maintained at an initial position.

Both ends of the restoring springs s1 and s2 may be fixed to the support frame 140 to which the support ring 150 and the fixing frame 160 may be fixed. As the support ring 150 and the knob ring 120 rotate while being integrated with each other, the knob ring 120 may remain at the initial position and may rotate clockwise or counterclockwise by a predetermined angle due to the elastic forces of the restoring springs s1 and s2.

The knob assembly according to embodiments may include the valve shaft 194 and the valve 190 which may be movable in multiple directions such as upward, downward, and laterally. Compared with a valve in which a valve shaft is at a fixed position with respect to a valve body, the valve 190 may have a structure in which the valve shaft 194 may be movable with respect to a valve body.

When the valve 190 is applied, a position of the knob handle 110 coupled with the valve shaft 194 may not be determined by the valve shaft 194, but the valve shaft 194 may move corresponding to the position of the knob handle 110. Accordingly, the position of the knob handle 110 may be restricted at a predetermined position with respect to the front panel c.

The knob handle 110 and the knob ring 120 may be assembled in place based on the front panel c, and the valve 190 may be assembled in the burner. Even if a position error occurs during an assembly process of the valve 190, the knob handle 110 and the knob ring 120 may be assembled at precise positions with respect to the front panel c. The above-described assembling structure may assemble the knob handle 110 and the knob ring 120 at precise positions with respect to the front panel c irrelevant to or regardless of a tolerance which may occur while the valve is manufactured and may allow the knob handle 110 and the knob ring 120 to smoothly operate.

A general valve may have a structure in which a valve shaft may not be movable with respect to a valve body and may only rotate in place. However, the valve 190 may have a structure in which the valve shaft 194 may be movable with respect to the valve body 191.

Figure 5:
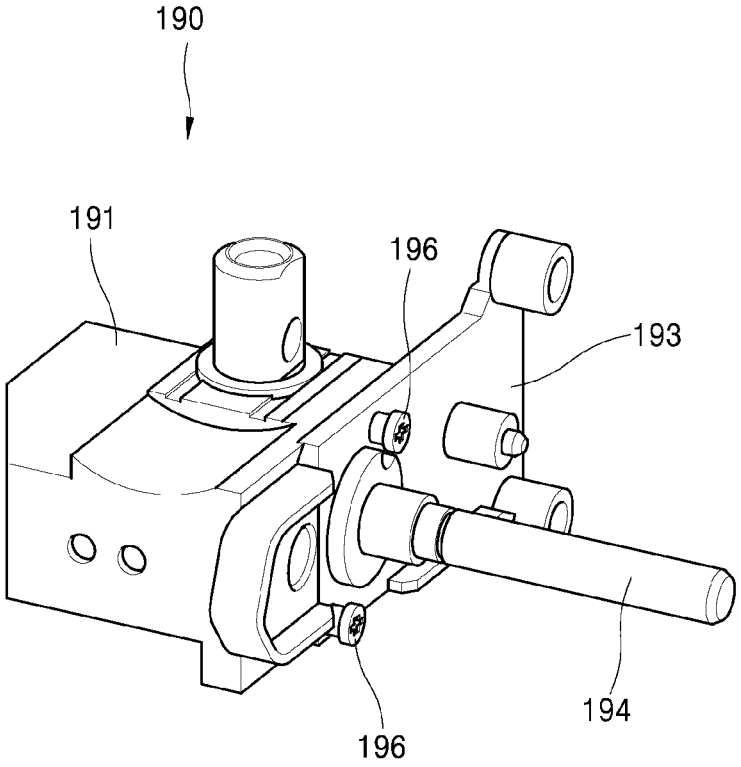
FIG. 5 is a perspective view of a valve according to an embodiment.
Figure 6:
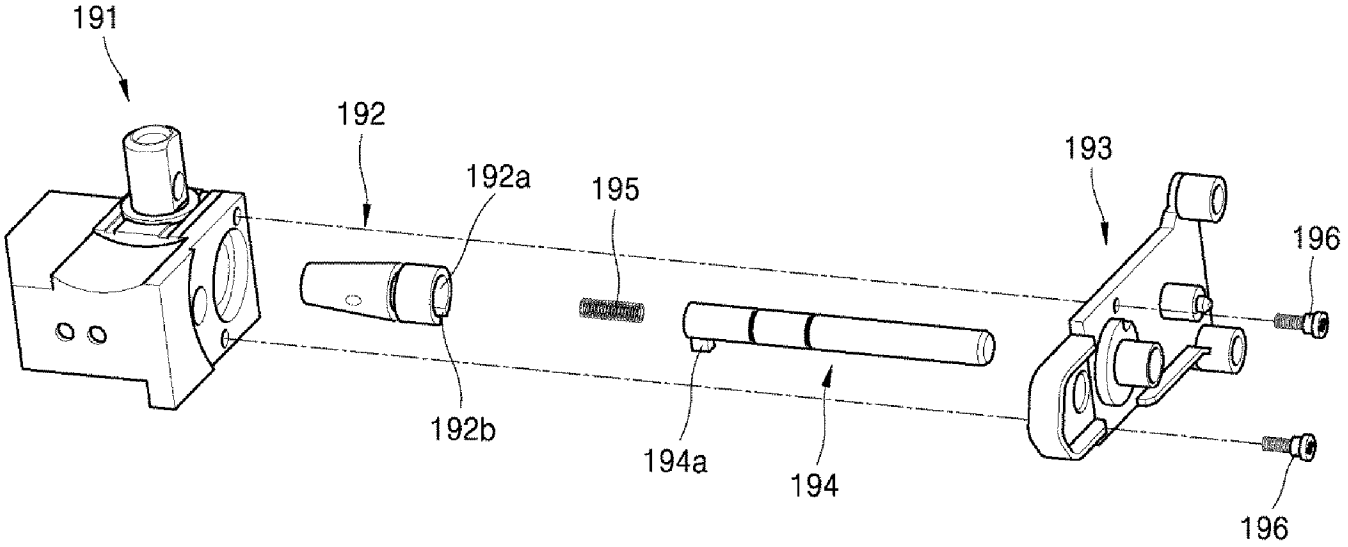
FIG. 6 is an exploded perspective view of the valve of FIG. 5.

Referring to FIG. 5 and FIG. 6, the valve 190 may include the valve body 191, an opening/closing portion 192 that rotates in the valve body 191 and adjusts an opening degree of the valve 190, the valve shaft 194 being movably inserted into the opening/closing portion 192, an elastic member or spring 195 inserted between the opening/closing portion 192 and the valve shaft 194 to provide an elastic force, and a valve cap 193 coupled with the valve body 191 via fastening members or screws 196 and through which the valve shaft 194 may penetrate.

The valve shaft 194 may include a key 194*a* that protrudes outward from an end inserted into the opening/closing portion 192, and the opening/closing portion 192 may include a central groove or insertion hole 192*a* into which the valve shaft 194 may be inserted and a key groove or recess 192*b* into which the key 194*a* may be inserted. As the valve shaft 194 is inserted into the opening/closing portion 192 with a gap therebetween, the valve shaft 194 may be movable with respect to the valve body 191. As the key 194*a* of the valve shaft 194 may be inserted into the key groove 192*b* of the opening/closing portion 192, rotation of the valve shaft 194 may be transferred to the opening/closing portion 192.

An outer diameter of the valve shaft 194 may be smaller than an inner diameter of the opening/closing portion 192, and a mutual size relation therebetween may be determined to prevent the key 194*a* from retreating from the key groove 192*b* even when the valve shaft 194 moves in the opening/closing portion 192. By allowing a width of the key 194*a* and a width of the key groove 192*b* to form a small gap corresponding to each other, the opening/closing portion 192 may rotate following rotation of the valve shaft 194 without a gap through the key 194*a* and the key groove 192*b* when the valve shaft 194 rotates.

The valve cap 193 may not pass through the key 194*a* of the valve shaft 194 so as to fix the valve shaft 194 to not deviate from the opening/closing portion 192. The elastic member 195 may provide an elastic force in a direction of pushing the valve shaft 194 from the opening/closing portion 192. Accordingly, due to the elastic force of the elastic member 195, the valve shaft 194 may maintain a state in which the key 194*a* may be in close contact with the valve cap 193 and may maintain a coupling capable of contracting into the valve cap 193 due to the external force.

Although embodiments of the valve has been described above, the valve is not limited thereto and may have a valve structure in which a valve shaft is movable with respect to a valve body. For example, there may be applied a structure in which a universal joint may be included in a valve shaft.

Figure 7:
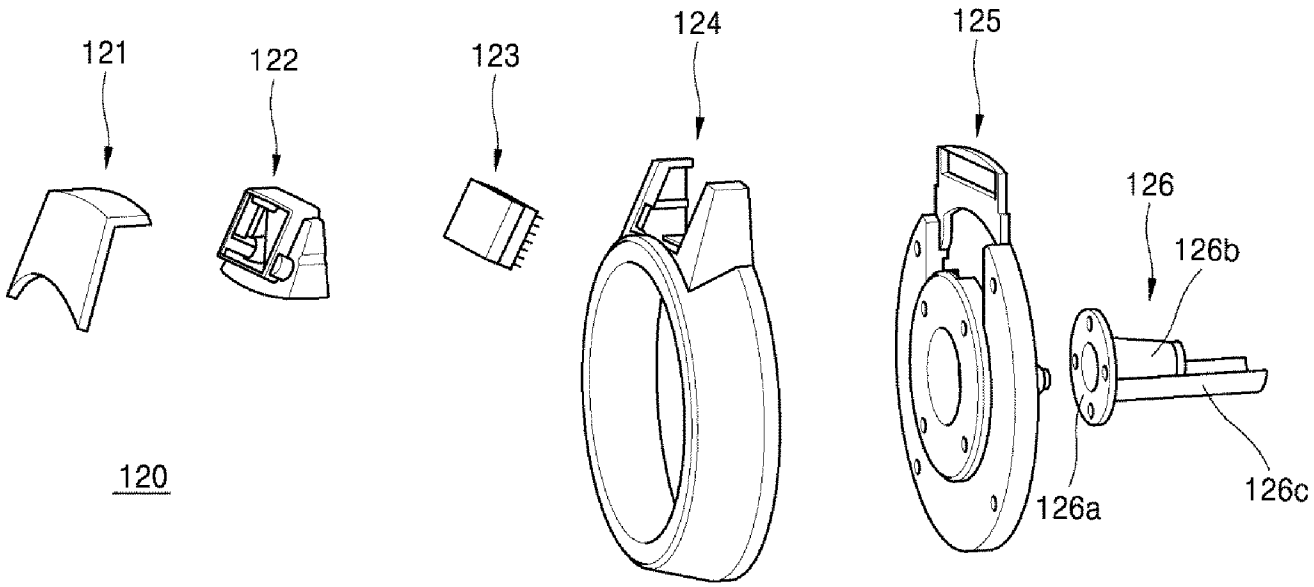
FIG. 7 is an exploded perspective view of a knob ring according to an embodiment.
Figure 8:
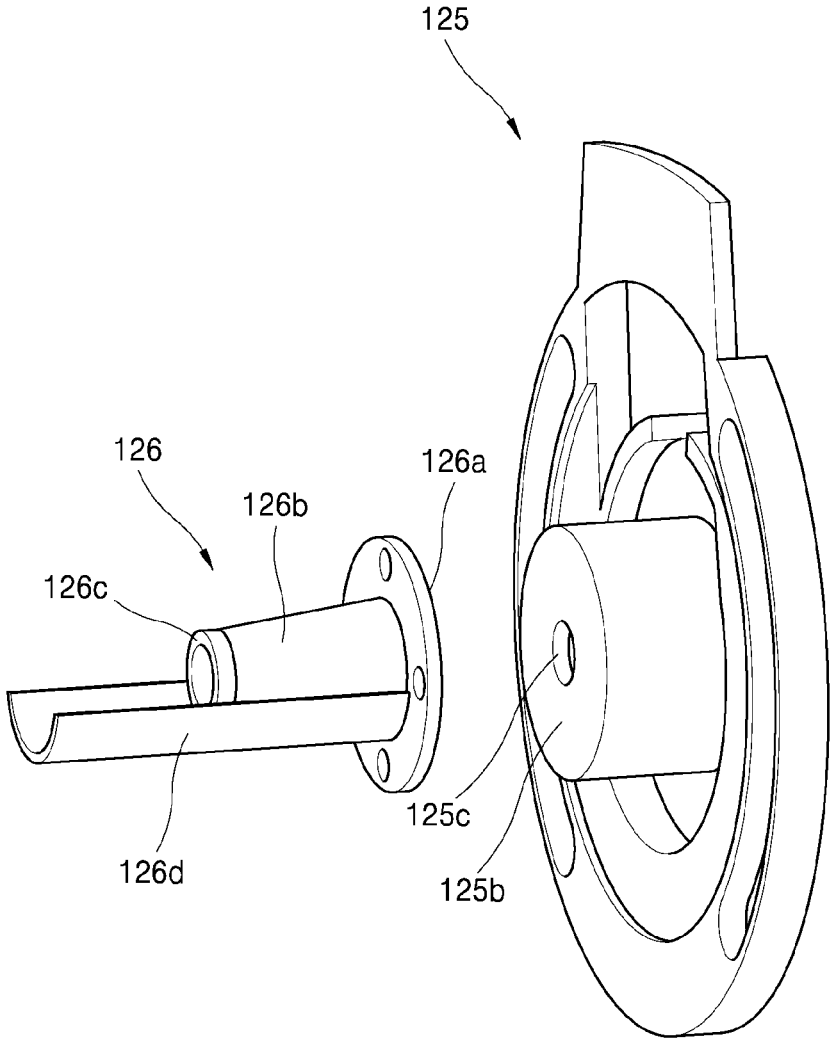
FIG. 8 is an exploded rear perspective view of components of the knob ring of FIG. 7.

Referring to FIG. 7 and FIG. 8, the knob ring 120 may include a knob ring body 124, a rear plate 125 coupled with a rear surface of the knob ring body 124, and a support tube 126 coupled with the rear plate 125 to support a knob shaft 114. The rear plate 125 may include a rear plate body 125*a* and a support plate 125*b* which may be provided in or on the front panel c and protrude toward the inside of the cooking apparatus. The support plate 125*b* may include a support hole 125*c* that supports the knob shaft 114.

The support tube 126 may be coupled with the rear plate 125. The support tube 126 may include a flange 126*a* coupled with the rear plate 125, a tapered tube 126*b* that extends from the flange 126*a*, and a support rib or extension 126*d* provided around the tapered tube 126*b* and extending longer than the tapered tube 126*b*.

The tapered tube 126*b* may have a tapered shape with a diameter decreasing as it extends away from the flange 126*a* and may include a supporter or end cap 126*c* that supports the knob shaft 114 at an end thereof. Thus, the knob shaft may be supported by two points such as the support hole 125*c* and the supporter 126*c*.

Figure 4:
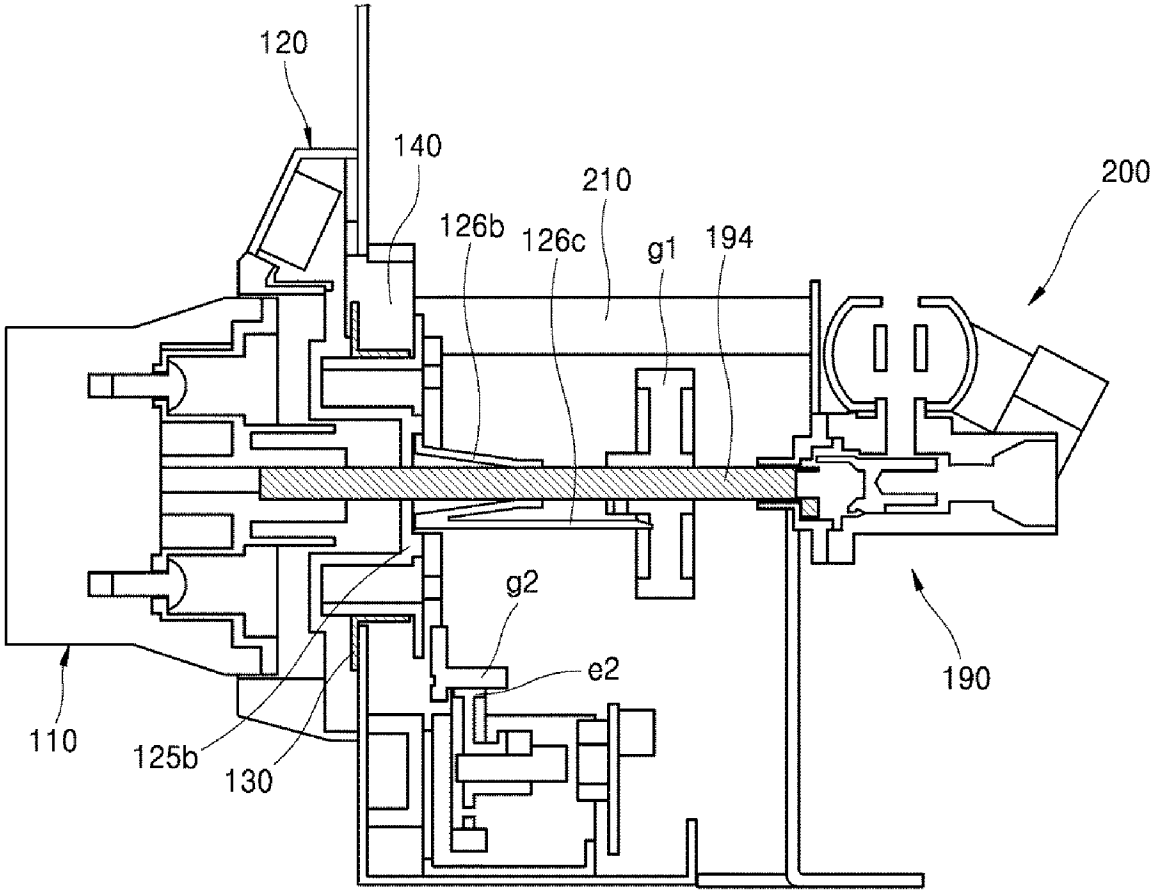
FIG. 4 is a cross-sectional view of the knob assembly of FIG. 1.

As there is a movable valve 190, a structure for stably supporting the valve shaft 194 is needed. Accordingly, the knob ring 120 may support the valve shaft 194 at least two points. The knob ring 120 may not only support the valve shaft 194 at two or more points but may also support a front end of the gear g1 coupled with the valve shaft 194. The gear g1 (as shown in FIG. 4) may transfer a rotational amount of the valve shaft 194 to the knob encoder e1 and may be supported while being loaded on the support rib 126*d*.

The knob ring 120 may also include a display 123 capable of displaying heating power or a time of a timer. The display 123 may be coupled with the knob ring body 124 through a display housing 122, and a finishing cap 121 may be coupled with outside thereof. The finishing cap 121 may be formed of a transparent or translucent material, for example, to allow information displayed on the display 123 to be seen or viewed from an outside.

Figure 9:
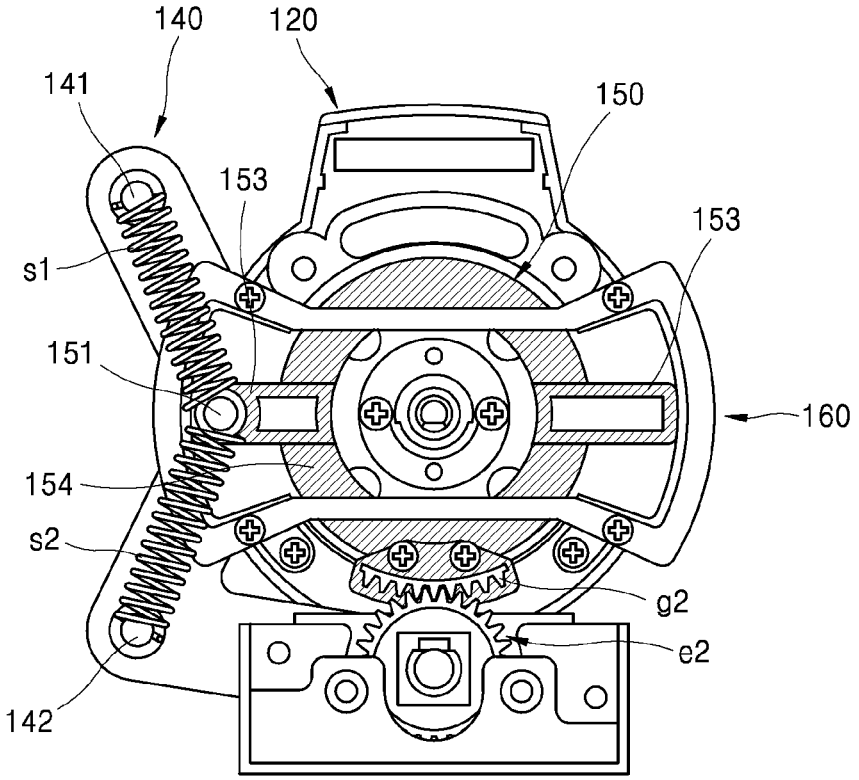
FIG. 9 is a rear view of the knob assembly of FIG. 1.

Referring to FIG. 9, a front surface of the front panel c may be coupled with the knob handle 110 and the knob ring 120, and a rear surface of the front panel c may be coupled with the support frame 140, the support ring 150, and the fixing frame 160. The fixing frame 160 may be fastened to the rear surface of the front panel c, the support ring 150 may be fastened to the knob ring 120 through the front panel c. A rotational center of the support ring 150 may be provided to coincide with a shaft center of the knob shaft 114. The support ring 150 may restrict the shaft center of the knob shaft 114 at a position with respect to the front panel c. When the support ring 150 is fixed at a position with respect to the front panel c, the knob shaft 114 may be fixed with respect to the front panel c corresponding thereto.

The support ring 150 may be inserted into the support frame 140, may pass through the front panel c, and may partially protrude from the front surface of the front panel c. A front end of the support ring 150 may be formed in a cylindrical shape, and a cylindrical part may protrude from the front surface of the front panel c.

The knob ring 120 may be coupled with the support ring 150 that protrudes from the front surface of the front panel c. As the knob ring 120 and the support ring 150 may be coupled with each other, the knob ring 120 may be supported by the support frame 140 as a result.

An operation of the knob ring 120 may be recognized from rotation of the support ring 150. Providing an encoder to sense the operation of the knob ring 120 at the outside of the front panel c around the knob ring 120 may not be aesthetically pleasing as the knob ring 120 may be a part exposed outward from the front panel c. As the knob ring 120 may be integrated and coupled with the support ring 150, the rotation of the knob ring 120 may be sensed by providing the knob ring encoder e2 around the support ring 150 and sensing rotation of the support ring 150.

The knob ring gear g2 that transmits or conveys a rotational angle may be provided at the support ring 150. The knob ring encoder e2 may be engaged with the gear g2 and may read the rotational angle of the support ring 150. The knob ring encoder e2 may be engaged with the knob ring gear g2 and may read or recognize a rotational operation signal of the knob ring 120.

The support ring 150 may be connected to the restoring springs s1 and s2 to return to a predetermined position. The restoring springs s1 and s2 may connect the support frame 140 to the support ring 150. When the support ring 150 is operated counterclockwise, the restoring spring s1 may provide an elastic force clockwise to allow the support ring 150 to return to an original position. When the support ring 150 is operated clockwise, the restoring spring s2 may provide an elastic force counterclockwise to allow the support ring 150 to return to the original position.

The fixing frame 160 may be provided to prevent the support ring 150 from deviating at a rear surface to allow the support ring 150 to stably operate. The fixing frame 160 may pass through the rear surface of the support ring 150 and may prevent the support ring 150 from deviating at the rear surface. The fixing frame 160 may be fastened to the support frame 140. The fixing frame 160 may restrict the rotational range of the support ring 150.

The support ring 150 may have a support ring body 154 and at least one wing portion or wing 153 that extends in one direction, and the pair of restoring springs s1 and s2 may be fixed to the wing 153. As a pivoting range of the wing 153 may be restricted by the fixing frame 160, a bidirectional rotational angle of the support ring 150 may be uniformly restricted.

To more stably restrict the rotation of the support ring 150, the wing 153 may be provided at both sides of the support ring 150, and the fixing frame 160 may uniformly restrict pivoting ranges of both the wings 153. One or a first end of each of the restoring springs s1 and s2 may be connected to an elastic member holder 151 on the support ring 150, and another or a second end of each of the restoring springs s1 and s2 may be connected to a first spring holder 141 of the support frame 140 and a second spring holder 142 of the support frame 140, respectively.

Embodiments disclosed herein provide a knob assembly that may improve aesthetics of an external shape of a cooking apparatus by fixing a knob handle to be aligned with a front panel. The knob assembly may remove jamming that occurs when the knob handle is operated by applying a valve to allow a valve shaft to flexibly move, may prevent a position error generated when the valve is assembled with a movable valve shaft, and may allow the valve shaft to be stably supported by a knob ring. The knob assembly may improve user convenience by setting a time of a timer through operating the knob ring and displaying the time of the timer on a display provided at or on the knob ring.

Embodiments disclosed herein provide a knob assembly that may include a knob handle that controls a heating power of a cooking apparatus and a knob ring and be capable of being precisely aligned in a center of a front panel of the cooking apparatus. Embodiments disclosed herein also provide a knob assembly precisely aligned with a front panel of a cooking apparatus to prevent jamming or malfunctioning that may occur while a knob handle and a knob ring operate.

According to embodiments disclosed herein, a knob assembly may include a valve that may have a structure in which a valve shaft may be movable, a knob handle coupled with the valve shaft, a knob ring that surrounds the periphery of the knob handle and may be provided to pass through a front panel to support a knob shaft, a support ring coupled with the knob ring, a support frame coupled with the front panel to support an outer circumferential surface of the support ring, and a fixing frame coupled with the support frame to prevent the support ring from deviating or separating from the support frame. The knob assembly may further include a frame to which the valve may be fixed and a guide bar that may fix the support frame to more strongly and precisely fix a position of the support frame.

The valve may include a valve body, an opening/closing portion inserted into the valve body to adjust a flow rate, the valve shaft being inserted into the opening/closing portion, an elastic member inserted between the opening/closing portion and the valve shaft, and a valve cap that prevents the valve shaft from deviating or separating from the opening/closing portion. The valve shaft may include a protruding key in a section inserted in the opening/closing portion, and the opening/closing portion may include an insertion hole into which the valve shaft may be inserted and a key groove into which the key may be inserted.

The knob ring may support the knob shaft at two or more points, and may include a knob ring body, a rear plate including a support hole that supports the valve shaft coupled with a rear surface of the knob ring body and passing therethrough, and a support tube coupled with the rear plate to support the valve shaft. The support tube may include a flange coupled with the rear plate, and a tapered tube that extends from the flange, and may include a supporter that supports the valve shaft.

The knob assembly may further include a disc portion inserted between the knob ring and the front panel, and a bearing shell including a cylinder portion inserted between the support ring and the support frame. The bearing shell allows the knob ring to smoothly operate, and may prevent the front panel from being damaged.

The knob assembly may further include a knob ring encoder that senses rotation of the support ring and a knob encoder that senses rotation of the valve shaft to display a time of a timer or a heating power sensed on a display device or display provided at the knob ring.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application relates to U.S. application Ser. Nos. 15/899,583, 15/899,637, 15/899,730, 15/899,797; all filed on Feb. 20, 2018, which are hereby incorporated by reference in their entirety. Further, one of ordinary skill in the art will recognize that features disclosed in these above-noted applications may be combined in any combination with features disclosed herein.

What is claimed is:

1. A knob assembly, comprising:

a valve including a valve shaft;

a knob provided at a front surface of a front panel of a cooking appliance and having a knob shaft coupled with the valve shaft;

a knob ring that rotates independent of the knob and surrounds a periphery of the knob and supports the knob shaft to restrict lateral movement of the knob with respect to the knob ring;

a support ring provided at a rear surface of the front panel and coupled with the knob ring;

a support frame coupled with the rear surface of the front panel, the support frame having a guide that supports an outer circumferential surface of the support ring to restrict lateral movement of the support ring with respect to the front panel; and a fixing frame coupled with the support frame to prevent the support ring from separating from the support frame.

2. The knob assembly of claim 1, wherein the valve includes:

a valve body;

an opening/closing portion inserted into the valve body to adjust a flow rate of a fluid passing through the valve, the valve shaft being movably inserted into the opening/closing portion;

an elastic spring inserted between the opening/closing portion and the valve shaft; and a valve cap that prevents the valve shaft from separating from the opening/closing portion.

3. The knob assembly of claim 2, wherein the valve shaft includes a key, wherein the key is configured to be inserted in the opening/closing portion, and wherein the opening/closing portion includes an insertion hole into which the valve shaft is inserted and a key groove into which the key is inserted.

4. The knob assembly of claim 2, wherein the valve cap is coupled to the valve body by at least one screw.

5. The knob assembly of claim 1, wherein the knob ring supports the knob shaft at two or more points.

6. The knob assembly of claim 5, wherein the knob ring includes:

a knob ring body;

a rear plate including a support hole that supports the valve shaft coupled with a rear surface of the knob ring body, the valve shaft passing through the support hole; and a support tube coupled with the rear plate to support the valve shaft.

7. The knob assembly of claim 6, wherein the support tube includes:

a flange coupled with the rear plate; and a tapered tube that extends from the flange and includes a supporter that supports an end of the valve shaft.

8. The knob assembly of claim 1, wherein the fixing frame is configured to restrict rotation of the support ring within a predetermined angle range.

9. The knob assembly of claim 8, wherein the fixing frame has a bow-tie shape such that ends of the fixing frame restrict the support ring.

10. The knob assembly of claim 1, wherein the valve is fixed to a frame and the support frame is fixed to a guide bar on the frame.

11. The knob assembly of claim 1, further including:

a disc portion inserted between the knob ring and the front panel; and a bearing shell that includes a cylinder portion inserted between the support ring and the support frame.

12. The knob assembly of claim 1, further comprising:

a knob ring encoder that senses rotation of the support ring; and a knob encoder that senses rotation of the valve shaft.

13. The knob assembly of claim 1, wherein the knob ring further includes a display that displays a time of a timer or a heating power.

14. The knob assembly of claim 1, wherein the knob ring further includes a display that displays a time of a timer and a heating power on a same surface of the display.

15. The knob assembly of claim 1, wherein the support ring includes a support ring body and at least one wing that extends out in at least one direction from the support ring body, and wherein a pair of restoring springs are fixed to the at least one wing.

16. A cooking apparatus including the knob assembly of claim 1.

17. A cooking apparatus, comprising:

a panel having a front surface and a rear surface;

a rotatable knob that controls operation of a burner, wherein the rotatable knob is connected to a knob shaft;

a knob ring that surrounds a periphery of the knob, the knob ring being provided on the front surface of the panel and passing through the panel so as to support the knob shaft;

a valve that adjusts a flow rate of gas introduced to the burner, the valve including a valve shaft coupled with the knob shaft;

a support ring coupled with the knob ring;

a support frame provided on the rear surface of the panel to support an outer circumferential surface of the support ring, the support frame configured to restrict a lateral movement of the rotatable knob and the knob ring relative to the panel; and a fixing frame coupled with the support frame to prevent the support ring from moving as the knob is rotated.

18. The cooking apparatus of claim 17, wherein the valve includes:

a valve body;

an opening/closing portion inserted into the valve body to adjust the flow rate of gas, the valve shaft being movably inserted into the opening/closing portion;

an elastic spring inserted between the opening/closing portion and the valve shaft; and a valve cap that prevents the valve shaft from separating from the opening/closing portion.

19. The cooking apparatus of claim 18, wherein the valve shaft includes a key, wherein the key is configured to be inserted in the opening/closing portion, and wherein the opening/closing portion includes an insertion hole into which the valve shaft is inserted and a key groove into which the key is inserted.

20. The cooking apparatus of claim 17, wherein the support ring includes a support ring body and a wing that extends out from the support ring body, and wherein ends of a pair of restoring springs are fixed to the wing to restore a position of the knob after the knob is rotated.

21. The cooking apparatus of claim 17, wherein the fixing frame has a bow-tie shape to restrict rotation of the knob and the support ring within a predetermined angle range.

* * * * *